United States Patent [19]

Hansen et al.

[11] Patent Number: 4,536,187

[45] Date of Patent: Aug. 20, 1985

[54] COMPOSITIONS COMPRISING COAL, WATER AND POLYELECTROLYTE

[75] Inventors: Bertil V. Hansen, Helsingborg; Sten S. Kelfve, Påarp; Henri R. Mollberg, Helsingborg, all of Sweden

[73] Assignee: AB Carbogel, Helsingborg, Sweden

[21] Appl. No.: 495,355

[22] PCT Filed: Sep. 13, 1982

[86] PCT No.: PCT/SE82/00279

§ 371 Date: May 12, 1983

§ 102(e) Date: May 12, 1983

[87] PCT Pub. No.: WO83/01069

PCT Pub. Date: Mar. 31, 1983

[30] Foreign Application Priority Data

Sep. 22, 1981 [SE] Sweden ..... 8105583

[51] Int. Cl.[3] ..... C10L 1/32

[52] U.S. Cl. ..... 44/51; 44/62; 44/70; 44/72; 44/76; 44/77; 252/318; 252/353

[58] Field of Search ..... 44/51, 62, 72, 77, 76, 44/70; 252/318, 353; 241/15, 16

[56] References Cited

U.S. PATENT DOCUMENTS

| | | | |
|---|---|---|---|
| 2,346,151 | 4/1944 | Burk | 44/51 X |
| 2,359,325 | 10/1944 | McConnell | 44/51 X |
| 3,168,350 | 2/1965 | Phinney | 44/51 X |
| 3,524,682 | 8/1970 | Booth | 302/66 |
| 3,762,887 | 10/1973 | Clancey | 44/51 X |
| 4,076,505 | 2/1978 | Dessau | 44/1 R |
| 4,094,810 | 6/1978 | Thomas | 44/51 X |
| 4,126,277 | 11/1978 | Manfroy et al. | 241/16 |
| 4,162,044 | 7/1979 | Manfroy | 241/16 |
| 4,162,045 | 7/1979 | Katzer | 241/16 |
| 4,217,109 | 12/1980 | Siwersson et al. | 44/51 |
| 4,242,098 | 12/1980 | Braun et al. | 44/51 |
| 4,302,212 | 11/1981 | Yamamura et al. | 44/51 |
| 4,304,572 | 12/1981 | Wiese et al. | 44/51 |
| 4,304,573 | 12/1981 | Burgess et al. | 44/51 |

FOREIGN PATENT DOCUMENTS

| | | | |
|---|---|---|---|
| 0008628 | 3/1980 | European Pat. Off. | 44/51 |
| 57-0092089 | 6/1982 | Japan | 44/51 |

*Primary Examiner*—William R. Dixon, Jr.
*Assistant Examiner*—Margaret B. Medley
*Attorney, Agent, or Firm*—Gordon W. Hueschen

[57] ABSTRACT

This invention relates to compositions substantially containing pulverized coal, water, polyelectrolyte and, optionally, a stabilizing agent. The polyelectrolyte is a water soluble polyethylene, optionally containing double bonds and/or branching points in the polymer chain, being directly substituted with (a) hydroxysulfonyloxy groups or (b) sulfo groups, (c) hydroxysulfonyloxy-lower alkyl groups which are partly or completely in salt form and optionally (d) substituents selected from hydroxy, lower alkyl, lower alkanoyloxy, carbamoyl, cyano, hydroxymethyl, chloro and phenyl, whereby the polyelectrolyte contains at most four different kinds of said optional substituents, and wherein the amount of sulfur of the polyelectrolyte is 2 to 25 percent by weight being calculated when the acid forming groups are present as free acids. Small amounts of these polyelectrolytes in water with a high percentage of pulverized coal form compositions, characterized by low viscosity, good flowability, pumpability and stability.

15 Claims, No Drawings

COMPOSITIONS COMPRISING COAL, WATER AND POLYELECTROLYTE

The present invention relates to compositions containing coal. Specifically the invention refers to aqueous compositions of pulverized coal and a polyelectrolyte, the composition being characterized by low viscosity and good stability at a high content of solid material.

BACKGROUND OF THE INVENTION

The high oil prices now prevailing have increased the interest in the great supplies of coal. Different methods have been suggested to make use of these supplies. One method proposed for the transportation and burning or gasifying of coal involves pulverizing the coal into very fine particles and, optionally, purifying the coal. Then the particles are dispersed into water to a slurry that can be transported to industrial and heating plants for use in the chemical and energy field.

The above mentioned method to transport and burn or gasify coal is e.g. described in the U.S. Pat. Nos. 3,524,682 and 4,217,109 and in the European patent application No. 8628.

The U.S. Pat. No. 3,524,682 discloses that it is possible to facilitate the pumping of suspensions of pulverized solid materials, such as minerals and coal, by adding a small quantity of a water soluble polyelectrolyte, obtained by polymerization of acrylic acid, acrylonitrile and similar compounds, to a system of water and pulverized solid material, the molecular weights of the polyelectrolytes preferably varying between 100 000 and $3\times10^6$.

Furthermore, the U.S. Pat. No. 4,217,109 discloses that polyelectrolytes of e.g. polycarboxylic acids or salts thereof, e.g. polyacrylates, can be used as additives in suspensions of coal and water. According to this patent the polyelectrolyte acts i.a. as an agent for separating the coal from other substances in the coal/water-slurry.

In both these U.S. patents it is stated that it is suitable to work with a water content of about 40% by weight (see Example 1 in the U.S. Pat. No. 3,524,682 and column 4 lines 31–33 in the U.S. Pat. No. 4,217,109).

In the European patent application No. 8628 there is disclosed a slurry of coal in water, also containing a water soluble polymer that might be poly(ethylene oxide), poly(acrylamide), hydroxyethyl cellulose, quaternary nitrogen-substituted cellulose esthers, xanthan gum, hydroxy propyl guar gum and carboxymethyl hydroxypropyl guar gum. This patent application states that it is possible to produce transportable coal/water slurries with a coal content of up to 78% by weight. However, according to the patent application, these slurries with an extremely high percentage of coal are not transported by normal pumps but by extruders, intended for materials with very high viscosity. The running of these extruders requires a great amount of energy and therefore it is absolutely unrealistic to use them for long-distance transports.

A big problem with these known methods for transporting coal is to achieve pumpability at low water contents, i.e. high percentages of coal in the dispersions. A high content of coal is desirable to get good transport efficiency for the coal. According to our experience the addition of the above mentioned polymers to dispersions of coal in water gives mixtures with too high viscosity to be transported at reasonable costs.

GENERAL DESCRIPTION OF THE INVENTION

One object of the present invention is to provide a composition of coal and water having low viscosity, good stability and good flowability and pumpability.

Another object of the invention is to provide a composition of coal and water, the composition being characterized by a low content of water.

One further object of the present invention is to provide a composition of coal and water that can be burnt directly—without preceding dewatering—to obtain energy.

It has now been found that the addition of water soluble polyelectrolytes, different from the above mentioned polyelectrolytes or polymers to aqueous slurries of coal can decrease the viscosity and increase the flowability and pumpability of these slurries, thus making it possible to transport slurries with a higher content of coal than hitherto at reasonable costs.

The polyelectrolytes used according to the present invention are water soluble polyethylenes, optionally containing double bonds and/or branching points in the polymer chain, being directly substituted with (a) hydroxysulfonyloxy groups or (b) hydroxysulfonyloxy-lower alkyl groups, which are partly or completely in salt form and optionally (c) substituents selected from hydroxy, lower alkyl, lower alkanoyloxy, carbamoyl, cyano, hydroxymethyl, chloro and phenyl, whereby the polyelectrolyte contains at most four different kinds of said optional substituents, and wherein the amount of sulfur of the polyelectrolyte is 2 to 25 percent by weight being calculated when the acid forming groups are present as free acids.

In this disclosure the expression "lower" means that the group referred to contains one to four carbon atoms, inclusive.

Preferred lower alkyl, lower alkanoyloxy and lower alkylene groups are methyl, ethyl, acetoxy, propionyloxy and methylene groups, respectively.

In the following a polyelectrolyte according to the present invention will be referred to as PAS.

PAS containing at least 3 and preferably between 8 to 20% by weight of sulfur, being calculated when the acid forming groups are present as free acids, gives especially good results.

The molecular weight of PAS can vary within a broad range. Average molecular weights below $5\times10^6$, such as 1000 to $5\times10^6$ have given good results. Very good results have been obtained with PAS having average molecular weights between 1000 and $5\times10^5$.

PAS may also be in the form of block copolymers or graft copolymers.

As is mentioned above the polymer chain may contain double bonds and/or branching points but normally it is preferred that the polymer chain be saturated and unbranched.

Preferred acid forming groups in PAS are hydroxysulfonyloxy (hydrogen sulfate) groups.

It is also preferred that the polyelectrolyte, when optionally substituted, contains at most three different kinds of such optional substituents.

When optionally substituted it is preferred that the polyelectrolyte is substituted with substituents selected from hydroxy, methyl, ethyl, acetoxy, propionyloxy, carbamoyl, cyano and chloro, especially hydroxy and acetoxy.

PAS according to this invention are known compounds or can be prepared by known methods. (see e.g.

Methoden der organischen Chemie, Vol. XIV, Part 1 (1961), Editor Eugen Müller). Accordingly PAS to be used in the present invention can be prepared by polymerisation of monomers or mixtures of monomers containing the desired substituents or such substituents can be introduced in a suitable polymer to form PAS.

Among monomers which can be used to prepare PAS the following may be mentioned: Styrene, 1,3-butadiene, vinyl acetate, acrylamide, acrylonitrile, allyl alcohol, vinyl chloride, ethene, 1-butene and propene.

Desired substituents can be introduced in suitable polymers, e.g. by hydrolysis, alcoholysis, esterification, e.g. with sulfuric acid or sulfur trioxide, and addition reactions, e.g. with sulfuric acid.

The following polymers are preferred as starting materials for the preparation of PAS containing hydroxysulfonyloxy groups partly or completely in salt form and being substituted with substituents selected from hydroxy; acetoxy or propionyloxy; and optionally methyl: Poly(vinylacetates), Poly(vinylpropionates), Poly(1-propen-2-ylacetates) and copolymers of ethene or propene and vinylacetate. The ester groups in said polymers are first partly or completely hydrolyzed to free hydroxy groups, which then partly are transferred to hydroxysulfonyloxy groups or salts thereof.

Excellent results have been obtained with the following PAS:

Hydroxysulfonyloxy substituted polyethylenes further substituted (a) with hydroxy or (b) with hydroxy in combination with: Acetoxy; or methyl and acetoxy; or propionyloxy; or chloro; or chloro and acetoxy; or acetoxy and ethyl; or cyano and acetoxy; or cyano, acetoxy and carbamoyl; or carbamoyl and acetoxy; or acetoxy and phenyl; or acetoxy and contain; and Hydroxysulfonyloxymethyl substituted polyethylenes further substituted with (a) hydroxymethyl or (b) hydroxymethyl in combination with: Cyano; or carbamoyl; or phenyl.

A preferred form of PAS is obtained from poly(vinylacetates), in which at least half of the acetate group are replaced by free hydroxy groups and hydroxysulfonyloxy groups. In said form of PAS it is preferred that the polymer contains at least 3% by weight of acetate groups as calculated when the acid forming groups are present as free acids.

When the acid forming groups of PAS are in the form of salts, the saltforming cations preferably are selected from alkali metal and alkaline earth metal cations, especially sodium, potassium and calcium ions. Further the cations can be ammonium and organic ammonium. The salt-forming cations may also be a mixture of the ions mentioned above.

The size and the size distribution of the coal particles is also important. Tests have shown that good results are obtained when most of the particles are smaller than 500 μm, preferably between 0.1 μm and 200 μm.

Particularly good results are obtained when the size distribution of the coal particles results in a minimum of the void part of the volume of a powder of said coal particles.

In this connection coal refers to a solid carbonaceous material, preferably mineral coal, anthracite, bituminous coal, subbituminous coal, lignite, charcoal, cokes and the like.

The invention is not limited to compositions containing only one PAS as disclosed. In certain cases it is advantageous that the composition contains two or more PAS having different contents of sulfur and/or different molecular weights. Optionally other types of polyelectrolytes than PAS might be used in the composition. Whether one or more PAS and optionally other types of polyelectrolytes are to be used in a certain case is decided from experiments in laboratory scale, aiming at compositions with desired properties.

The slurries according to the present invention may also contain other additives than PAS to give the slurries certain properties. These other additives can be substances with a stabilizing, pH-adjusting, anticorrosive, combustion-promoting and/or antimicrobial effect.

In this connection it should be observed that it is often desirable to increase the stability of the compositions according to the invention against sedimentation. It has been found that suitable compounds that can be used for this purpose are inorganic salts, especially calcium or magnesium salts which can be water soluble or practically insoluble in water, such as calcium chloride, magnesium sulfate, calcium carbonates, calcium sulfates, calcium phosphates and the like where the water insoluble salts have a small particle size. Other such stabilizing compounds are organic compounds containing one or more ammonium ions, which can be primary, secondary, tertiary or quaternary, and which also may be present in the form of salts with PAS. Further such stabilizing compounds are poly(vinyl alcohol), gel forming clays, carboxymethyl cellulose, methyl cellulose, poly(ethylenoxides) and the like. Examples of suitable organic compounds, containing ammonium ions are alkylamines, e.g. triethylamine, cyclohexylamine, piperazine and its dialkyl derivatives; aminoalcohols, e.g. 2-(2-aminoethylamino)ethanol; 1,ω-diaminoalkanes e.g. 1,6-diaminohexane, 1,2-diaminoethane, 3-(dimethylamino)propylamine; poly(vinylamine), and poly(ethylenimine), of low molecular weight including e.g. diethylenetriamine and triethylenetetramine.

In the compositions according to the invention there may be included more or less oil or other volatile organic liquids in addition to the contaminations being a natural part of the solid coal.

The composition of the aqueous coal slurries according to the invention can vary within wide ranges depending on the type of coal, type of PAS etc. Satisfactory results have been obtained with between 15 and 40% by weight of water, calculated on the total composition. Especially good results have been obtained with between 20 and 36% by weight of water.

Suitable amounts of PAS in the composition is between 0.01 and 5, preferably between 0.05 and 0.5 percent by weight.

The total amount of additives other than PAS can be determined by laboratory experiments, and has not been found to exceed 5% by weight of the composition.

For preparing the composition according to the invention coal, PAS, other additives and water can be mixed in arbitrary order. PAS can also be added before or while grinding, a better grinding effect being observed in certain cases.

The extra contribution of sulfur, originating from PAS at the combustion, is negligible. Normally the contribution of sulfur from PAS is less than 300 ppm.

The following examples are intended to illustrate but not to limit the scope of the invention.

EXAMPLE 1

Coal (Widow Kennedy Seam, Virginia, USA) is dried and sieved (particle size less than 225 μm).

Suspensions are prepared by carefully mixing 66 g of this coal, a water solution of PAS or other polymers and water to a final weight of 100 g. The water percentage of these suspensions is 34. The percentage of PAS or polymer appears in table 1 below. The viscosity of the suspensions is measured after 30 minutes of mixing (viscosimeter Brookfield LVT, measuring body No. LV 3, 30 r.p.m.). The stabilizing time before reading is 1½ minutes. The viscosity is calculated from the read figure multiplied by the Brookfield-factor in accordance with the directions of the manufacturer.

Maximum measureable viscosity is 4000 centipoise (cP).

The results obtained are shown in Table 1.

As appears from the table, none of the previously known polymers (additives 2–4) used in this connection or other polymers outside this invention (additives 16, 18, 21) has shown a viscosity decreasing effect comparable with that of PAS.

Using the same experimental conditions compositions containing coal powders obtained from other sources and classified as mineral coal, anthracite, bituminous coal, subbituminous coal, lignite, charcoal and cokes are found to give results comparable to those shown in Table 1, using additives Nos. 6, 10, 13, 23, and 25 in said table.

EXAMPLE 2

This example shows the formulation of compositions according to the invention, which have low viscosity and a low percentage of water in accordance with example 1 and also a very good stability.

The figures are referring to percentage by weight of the total composition:

| Composition 1 Components | Percentage |
|---|---|
| Coal | 68 |
| Water | 32 |
| PAS[1] | 0.15 |
| 1,2-diaminoethane | 0.05 |

[1]Additive No. 6 of Table 1 in Example 1

Similar results are obtained when 1,2-diaminoethane is exchanged for 3-(dimethylamino)propylamine, poly(vinylamine), diethylenetriamine and triethylenetetramine.

| Composition 2 Components | Percentage |
|---|---|
| Coal | 68 |
| Water | 31 |
| PAS[2] | 0.15 |
| Calcium carbonate | 1 |

[2]Additive No. 10 of Table 1

Similar results are obtained when calcium carbonate is replaced with finely ground calcium phosphate (apatite).

| Composition 3 Components | Percentage |
|---|---|
| Coal | 71 |
| Water | 28.5 |
| PAS[3] | 0.15 |
| Calcium chloride | 0.5 |

[3]Additive No. 8 of Table 1

EXAMPLE 3

Suspensions of coal (Widow Kennedy Seam) in water is prepared as in Example 1 but made with 32% by weight of water. The viscosity is measured with a rotating viscosimeter (Contraves Rheomat 115) at 25° C. using the cup-bob combination No. 125. The shearing rate is 32.3 $sec^{-1}$ and the reading is made after 6 minutes of shearing.

The amount of additive required to reduce the viscosity to 0.20 Pa×sec is determined. The results are shown below.

It is evident from these data that considerably smaller amounts of PAS than of Lomar D (sodium salt of a copolymer of naphfthalenesulfonic acid and formaldehyde) are required to give the same reduction of the viscosity.

| Additive | Degree of polymerisation | % S as in Table 1 | Additive concentration to give 0.20 Pa × sec, % by weight |
|---|---|---|---|
| Sulfated | 70 | 10 | 0.12 |
| poly(vinyl-alcohol) | 500 | 19 | 0.15 |
| Lomar D | | | 0.23 |

EXAMPLE 4

Coal suspensions are made and their viscosity is measured as described in Example 3. All the suspensions contain additive No. 10 of Table 1. The concentration of additive giving the minimum viscosity is measured at several coal concentration and the following results are obtained:

| % by weight of coal | Minimum viscosity Pa × sec | Additive concentration, % by weight |
|---|---|---|
| 68 | 0.13 | 0.19 |
| 75 | 1.0 | 0.45 |
| 78 | 3.0 | 1.0 |

TABLE 1

| No. | Additives PAS and other polymers | Cation | % by weight of polymer in the composition | Degree of polymerisation | Sulfur content % (1) | Viscosity in cP |
|---|---|---|---|---|---|---|
| 1 | None | — | — | — | — | >4000 |
| 2 | Polyacrylic | Na | 0.05–0.3 (4) | 7500 | — | >4000 |

TABLE 1-continued

| No. | Additives PAS and other polymers | Cation | % by weight of polymer in the composition | Degree of polymerisation | Sulfur content % (1) | Viscosity in cP |
|---|---|---|---|---|---|---|
| | acid (2) | | | | | |
| 3 | Polyethylene-oxide (3) | — | 0.05–0.3 (4) | 2300 | — | >4000 |
| 4 | Xanthan gum (3) | — | 0.05–0.3 (4) | — | — | >4000 |
| 5 | Sulfated poly(vinyl-alcohol) (5) | Na | 0.1 | 45 | 16 | 230 |
| 6 | Sulfated, poly(vinyl-alcohol), purified | $NH_4$ | 0.1 | 45 | 16 | 210 |
| 7 | Sulfated, poly(vinyl-alcohol), purified | $NH_4$ | 0.1 | 230 | 17 | 300 |
| 8 | Sulfated poly(vinyl-alcohol) (5) (6) | Ca | 0.1 | 320 | 16 | 330 |
| 9 | Sulfated, poly(vinyl-alcohol), purified | $NH_4$ | 0.1 | 500 | 8 | 680 |
| 10 | Sulfated poly(vinyl-alcohol) (5) | Ca | 0.1 | 500 | 19 | 250 |
| 11 | Sulfated, poly(vinyl-alcohol), purified (7) | $NH_4$ | 0.1 | 1000 | 13 | 390 |
| 12 | Sulfated poly(vinyl-alcohol) (5) | Na | 0.1 | 4500 | 9 | 760 |
| | Mixture of additives No. 11 and No. 5 | | 0.07<br>0.03 | | | 370 |
| 13 | Sulfated copolymer of vinyl-alcohol and ethene (8) | Na | 0.1 | 790 | 17 | 240 |
| 14 | Sulfated copolymer of vinyl-alcohol, vinyl acetate and propene (9)(5) | Na | 0.1 | 130 | 16 | 280 |
| 15 | Sulfated polymer of 1-propen-2-ol (10) | Ca | 0.1 | 180 | 14 | 300 |
| 16 | Poly(ethenesulfonic acid) | Na | 0.05–0.3 | 22 | 29 | >4000 |
| 17 | Poly(vinyl alcohol) 99% hydrolyzed | — | 0.05–0.3 | 1700 | 0 | >4000 |
| 18 | Sulfated copolymer of vinyl alcohol, vinyl chloride and vinyl acetate (5)(12) | Na | 0.1 | 180 | 12 | 420 |
| 19 | Sulfated copolymer of butadiene, vinyl alcohol and vinyl acetate (5)(13) | Na | 0.1 | 140 | 15 | 630 |
| 20 | Copolymer of vinyl acetate and ethene sulfonic acid | Na | 0.05–0.3 | 250 | 1 | >4000 |
| 21 | Sulfated copolymer of vinyl alcohol, acrylonitrile and vinyl acetate (5) (14) | Ca | 0.1 | 210 | 12 | 570 |
| 22 | Sulfated copolymer of vinyl alcohol, acrylamide and vinyl acetate (5) (15) | Na | 0.1 | 170 | 13 | 480 |
| 23 | Sulfated copolymer of acrylonitrile, acryl- | Na | 0.1 | 450 | 9 | 390 |

TABLE 1-continued

| No. | Additives PAS and other polymers | Cation | % by weight of polymer in the composition | Degree of polymerisation | Sulfur content % (1) | Viscosity in cP |
|---|---|---|---|---|---|---|
| | amide, vinyl alcohol and vinyl acetate (5)(16) | | | | | |
| 24 | Sulfated copolymer of ethene (26 mole %) and allyl alcohol (74 mole %)(5) | Na | 0.1 | 90 | 12 | 430 |
| 25 | Sulfated poly-(allyl alcohol) (5) | Na | 0.15 | 62 | 17 | 400 |
| 26 | Sulfated copolymer of acrylonitrile (15 mole %) and allyl alcohol (85 mole %) (5) | Na | 0.1 | 85 | 14 | 620 |
| 27 | Sulfated copolymer of acrylamide (15 mole %) and allyl alcohol (85 mole %) (5) | Na | 0.1 | 140 | 13 | 530 |
| 28 | Sulfated copolymer of vinyl alcohol and vinyl propionate (5)(17) | Ca | 0.1 | 260 | 16 | 340 |
| 29 | Sulfated copolymer of vinyl alcohol, vinyl acetate and styrene (5)(18) | Na | 0.1 | 180 | 12 | 390 |

(1) % S by weight of polymer in acid form
(2) According to U.S. Pat. No. 3.524.682
(3) According to European patent application No. 8628
(4) Range investigated
(5) Contains inorganic salts
(6) Containing 4% by weight of acetyloxy groups
(7) Containing 23% by weight of acetyloxy groups
(8) Made from a 99% hydrolyzed copolymer of vinyl acetate (71 mole %) and ethene (29 mole %)
(9) Made from a 85% hydrolyzed copolymer of vinyl acetate (92 mole %) and propene (8 mole %)
(10) Made from 88% hydrolyzed poly(1-propen-2-ylacetate)
(11) Made from a 77% hydrolyzed copolymer of vinyl chloride (34 mole %) and vinyl acetate (66 mole %)
(12) Made from a 82% hydrolyzed copolymer of 1,3-butadiene (13 mole %) and vinyl acetate (87 mole %)
(13) Made from a 62% deacetylated copolymer of vinyl acetate (73 mole %) and acrylonitrile (27 mole %)
(14) Made from a 69% deacetylated copolymer of acrylamide (17 mole %) and vinyl acetate (83 mole %)
(15) Made from a 72% deacetylated copolymer of acrylamide (16 mole %), acrylonitrile (22 mole %) and vinyl acetate (62 mole %)
(16) Made from a 82% hydrolyzed poly(vinyl propionate)
(17) Made from a 92% hydrolyzed copolymer of styrene (19 mole %) and vinyl acetate (81 mole %)

We claim:

1. A composition comprising finely divided coal, water, and at least one polyelectrolyte, wherein the concentration of water of the composition is in the range from 15 to 40 percent by weight of the composition, and the concentration of said polyelectrolyte is in the range from 0.01 to 5 percent by weight of the composition, and wherein said polyelectrolyte has an average molecular weight below $5\times10^6$ and is a water-soluble polyethylene substituted directly on the polyethylene chain with (a) hydroxysulfonyloxy groups, or (b) hydroxysulfonyloxy-lower alkyl groups, which are partly or completely in salt form, and wherein the amount of sulfur of the polyelectrolyte is 2 to 25 percent by weight being calculated when the acid-forming groups are present as free acids.

2. A composition according to claim 1, wherein the polyelectrolyte further contains substituents selected from hydroxy, lower alkyl, lower alkanoyloxy, carbamoyl, cyano, hydroxymethyl, chloro and phenyl, and wherein the polyelectrolyte contains at most four different kinds of substituents.

3. A composition according to claim 1, wherein the amount of sulfur in the polyelectrolyte is 8 to 20 percent by weight.

4. A composition according to claim 1, wherein the polyelectrolyte has an average molecular weight between 1000 and $5\times10^5$.

5. A composition according to claim 1, wherein the concentration of the polyelectrolyte is in the range from 0.05 to 0.5 percent by weight of the composition.

6. A composition according to claim 1, wherein the concentration of the water is in the range from 20 to 36 percent by weight of the composition.

7. A composition according to claim 1, wherein said composition contains two or more polyelectrolytes having different content of sulfur and/or different molecular weights.

8. A composition according to any of the preceding claims, wherein the composition also comprises additives with stabilizing, pH-adjusting, anticorrosive, combusting promoting and/or antimicrobial effect.

9. A composition according to claim 8, wherein the composition includes a stabilizing agent selected from inorganic salts; organic compounds containing at least one primary, secondary, tertiary, or quaternary ammonium ion; poly(vinyl alcohol); gel forming clays; carboxymethyl cellulose; methyl cellulose; and poly(ethylnoxides).

10. A composition according to claim 9, wherein the stabilizing agent is an inorganic salt which is water-soluble or practically insoluble in water.

11. A composition according to claim 1, wherein the polyethylene is substituted with hydroxysulfonyloxy groups.

12. A composition according to claim 2, wherein the polyelectrolyte is substituted with substituents selected from hydroxy, methyl, ethyl, acetoxy, propionyloxy, carbamoyl, cyano and chloro.

13. A composition according to claim 12, wherein the polyelectrolyte is poly(vinylacetate), in which at least half of the acetate groups are replaced by free hydroxy groups and hydroxysulfonyloxy groups.

14. A composition according to claim 12, wherein the polyelectrolyte is substituted with a substituent selected from hydroxy and acetoxy.

15. A composition according to claim 13, wherein the polyelectrolyte contains at least 3 percent by weight of acetate groups as calculated when the acid forming groups are present as free acids.

* * * * *

UNITED STATES PATENT AND TRADEMARK OFFICE

CERTIFICATE OF CORRECTION

PATENT NO. : 4,536,187

DATED : August 20, 1985

INVENTOR(S) : Bertil V. Hansen, Sten S. Kelfve and Henri R. Mollberg

It is certified that error appears in the above-identified patent and that said Letters Patent is hereby corrected as shown below:

Col. 3, line 34; insert -- ing double bonds in the polyethylene chain -- after the word "contain"

Col. 3, line 40; "group" should read -- groups --

Col. 4, line 31; "compounds," should read -- compound -- (delete the comma)

Col. 6, line 46; "concentration" should read -- concentrations --

Col. 7, line 34; delete the line under "Mixture of"

Col. 10, line 62; change "any of the preceding claims" to -- claim 1 --

Signed and Sealed this

*Twenty-first* Day of *January 1986*

[SEAL]

*Attest:*

DONALD J. QUIGG

*Attesting Officer*

*Commissioner of Patents and Trademarks*